US008784142B2

(12) United States Patent
Golen

(10) Patent No.: US 8,784,142 B2
(45) Date of Patent: Jul. 22, 2014

(54) CONNECTOR BLOCK ASSEMBLY UTILIZING A SINGLE OUTPUT AND ASSOCIATED METHOD OF USE

(75) Inventor: Bruce Douglas Golen, Waterville, OH (US)

(73) Assignee: Regal Beloit America, Inc., Beloit, WI (US)

( * ) Notice: Subject to any disclaimer, the term of this patent is extended or adjusted under 35 U.S.C. 154(b) by 333 days.

(21) Appl. No.: 13/341,460

(22) Filed: Dec. 30, 2011

(65) Prior Publication Data

US 2013/0171881 A1 Jul. 4, 2013

(51) Int. Cl.
*H01R 4/36* (2006.01)

(52) U.S. Cl.
USPC ..... 439/810; 439/798

(58) Field of Classification Search
USPC ..... 439/709, 715, 797, 798, 801, 810–812
See application file for complete search history.

(56) References Cited

U.S. PATENT DOCUMENTS

| | | | | |
|---|---|---|---|---|
| 4,728,913 | A | 3/1988 | Ishikawa et al. | |
| 5,440,281 | A | 8/1995 | Wey et al. | |
| 5,739,731 | A | 4/1998 | Hicks et al. | |
| 5,831,490 | A | 11/1998 | Sarkka et al. | |
| 5,894,250 | A | 4/1999 | Ravaska et al. | |
| 5,986,520 | A | 11/1999 | Abeno et al. | |
| 6,542,049 | B2 | 4/2003 | Henningsson et al. | |
| 7,438,607 | B2 * | 10/2008 | Fong | 439/810 |
| 7,607,955 | B2 * | 10/2009 | Hill et al. | 439/798 |
| 7,946,896 | B2 * | 5/2011 | Waltz | 439/810 |
| 2002/0093393 | A1 | 7/2002 | Henningsson et al. | |

FOREIGN PATENT DOCUMENTS

| | | | |
|---|---|---|---|
| EP | 0432729 | A2 | 6/1991 |
| GB | 2418634 | A | 4/2006 |
| WO | 9113479 | A1 | 9/1991 |

* cited by examiner

*Primary Examiner* — Khiem Nguyen
(74) *Attorney, Agent, or Firm* — Thompson Coburn LLP

(57) ABSTRACT

A connector block assembly that includes two or more input terminals for receiving electrical input voltage, a single electrical conductor output that is electrically connected to two or more input terminals, an insulator base; wherein the plurality of input terminals for receiving electrical input voltage are mounted within the insulator base and the single electrical conductor output are transversely mounted either within the insulator base or to the outside of the outer insulator so that the single electrical conductor output is at an angle of about seventy degrees to about one hundred-ten degrees in relationship to the two or more input terminals with a variation of angles between these two values. The optimal embodiment is being a single electrical conductor output being substantially perpendicular at an angle of about ninety degrees in relationship to the plurality of input terminals.

8 Claims, 11 Drawing Sheets

CONNECTOR BLOCK ASSEMBLY UTILIZING A SINGLE OUTPUT AND ASSOCIATED METHOD OF USE

BACKGROUND OF THE INVENTION

Although a number of applications can be used with a collector block assembly with a common, single negative output buss, one of the most valuable is a photovoltaic (PV) power system that utilizes solar cells as a means of alternative energy. The collector block assemblies that have multiple input terminals are typically structured so that each input terminal is electrically connected to a corresponding output terminal. This is shown in collector block assembly 10 of FIG. 1 with input conductors 12 and an output conductor 14 that extends in parallel to the input conductors 12. This results in requiring significant space in an electrical panel to bend the output conductor or wiring resulting in a large bend radius for each conductor.

In addition, in other situations where a single, common output is desired, a large number of jumper connecting conductors are typically utilized. This is shown with another type of collector block assembly 11 in FIG. 2 with a jumper connecting conductor 16. The bend radius of each jumper conductor 16 also becomes an issue with regard to the size of the electrical panel housing the collector block assembly 11. Moreover, if there are multiple output conductors or jumper conductors, each conductor has the potential to break or lose electrical connection. This will result in a loss of an input voltage or signal. There is also significant troubleshooting time to figure out which specific output conductor is no longer connected.

The present invention is directed to overcoming one or more of the problems set forth above.

SUMMARY OF INVENTION

The present invention is directed to a connector block assembly. This connector block assembly includes two or more input terminals for receiving electrical input voltage, a single electrical conductor output that is electrically connected to the two or more input terminals, and an outer support frame; wherein the two or more input terminals for receiving electrical input voltage and the single electrical conductor output are transversely mounted within the outer support frame so that the single electrical conductor output is at an angle of about seventy degrees to about one hundred-ten degrees in relationship to the two or more input terminals. Preferably, the single electrical conductor output is at an angle of about eighty degrees to about one hundred degrees in relationship to the two or more input terminals and more preferably the single electrical conductor output is at an angle of about eighty-five degrees to about ninety-five degrees in relationship to the two or more input terminals. The optimal embodiment is the single electrical conductor output being substantially perpendicular at an angle of about ninety degrees in relationship to the two or more input terminals.

In another aspect of the invention, a connector block assembly is disclosed. This connector block assembly includes two or more input terminals for receiving electrical input voltage, a single electrical conductor output that is electrically connected to the two or more input terminals, and an outer support frame; wherein the two or more input terminals for receiving electrical input voltage and the single electrical conductor output are transversely mounted with the two or more input terminals for receiving electrical input voltage located within the outer support frame and the single electrical conductor output attached to the outside of the support frame with the single electrical conductor output at an angle of about seventy degrees to about one hundred-ten degrees in relationship to the plurality of input terminals. Preferably, the single electrical conductor output is at an angle of about eighty degrees to about one hundred degrees in relationship to the two or more input terminals and more preferably the single electrical conductor output is at an angle of about eighty-five degrees to about ninety-five degrees in relationship to the two or more input terminals. The optimal embodiment is the single electrical conductor output being substantially perpendicular at an angle of about ninety degrees in relationship to the two or more input terminals.

Still yet another aspect of the present invention is that a method for utilizing a connector block assembly is disclosed. The method includes utilizing two or more input terminals for receiving electrical input voltage that are located within an outer support frame and a single electrical conductor output that is electrically connected to the two or more input terminals; wherein the two or more input terminals for receiving electrical input voltage and the single electrical conductor output are transversely mounted with the two or more input terminals for receiving electrical input voltage located within the outer support frame so that the single electrical conductor output is at an angle of about seventy degrees to about one hundred-ten degrees in relationship to the plurality of input terminals. Preferably, the single electrical conductor output is at an angle of about eighty degrees to about one hundred degrees in relationship to the two or more input terminals and more preferably the single electrical conductor output is at an angle of about eighty-five degrees to about ninety-five degrees in relationship to the two or more input terminals. The optimal embodiment is the single electrical conductor output being substantially perpendicular at an angle of about ninety degrees in relationship to the two or more input terminals.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

Figure 1:
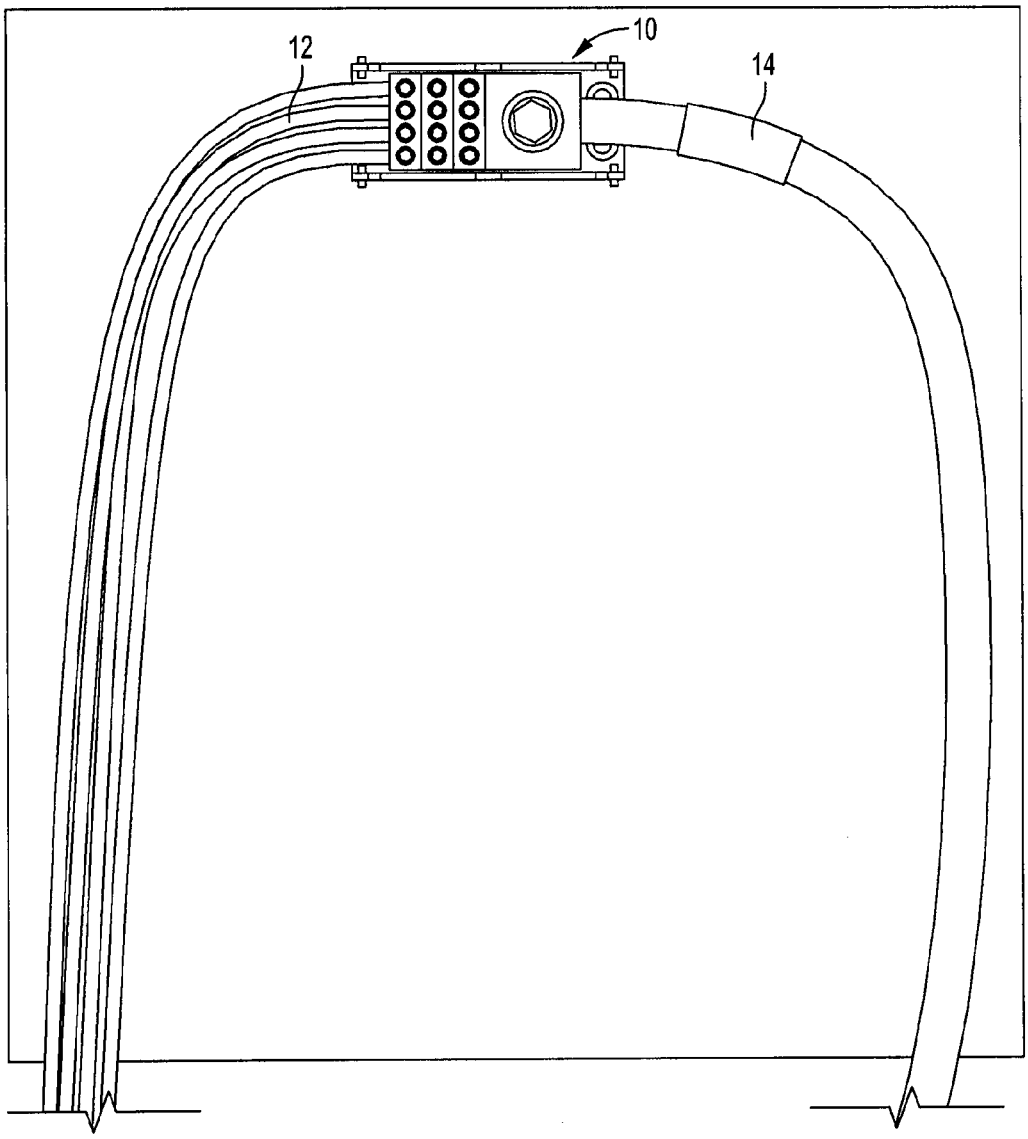
FIG. 1 (Prior Art)
FIG. 1 is a side elevational view of a collector block assembly in the prior art having input conductors and an output conductor that are in parallel to each other within an electrical panel.
Figure 2:
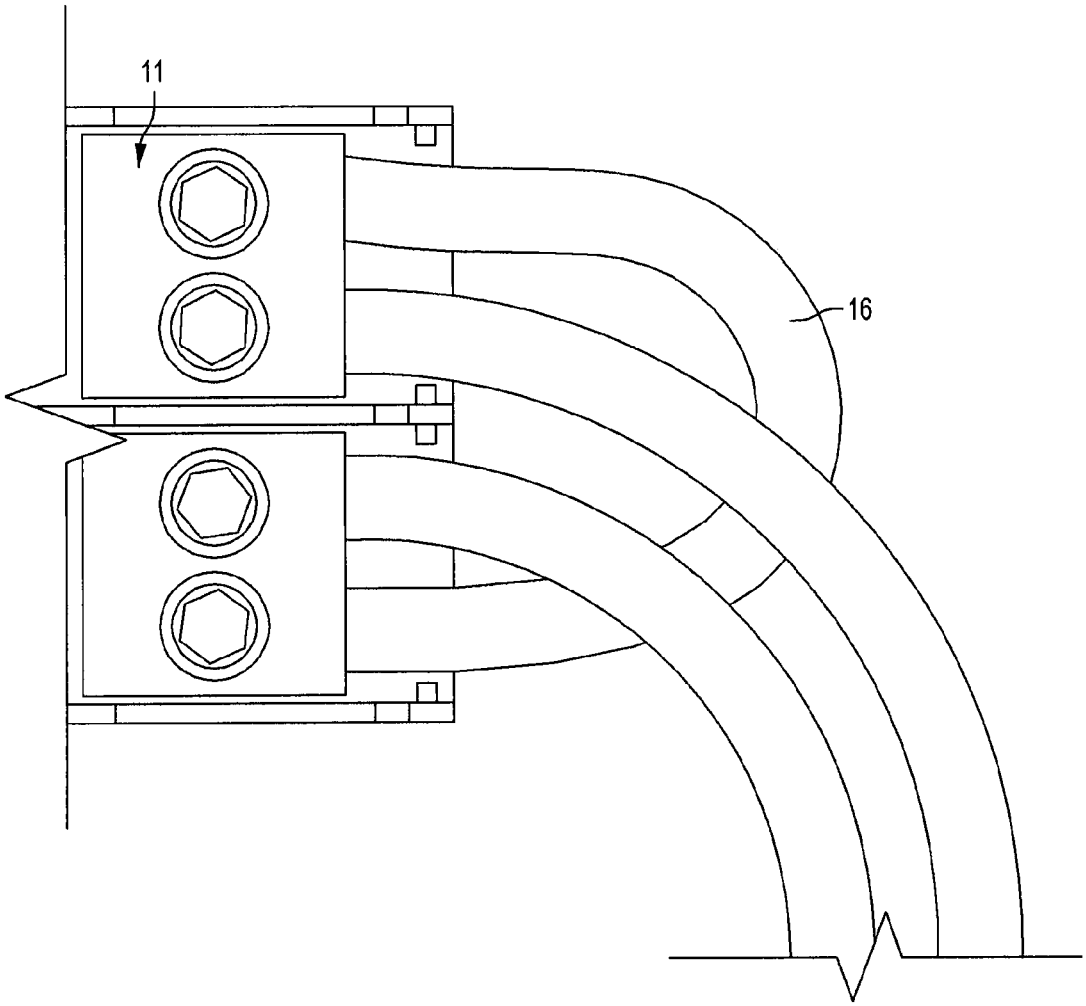
FIG. 2 (Prior Art)
FIG. 2 is a top view of another collector block assembly in the prior art that utilizes jumper conductors.

Reference characters in the written specification indicate corresponding items shown throughout the drawing figures.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as to obscure the present invention.

Figure 3:
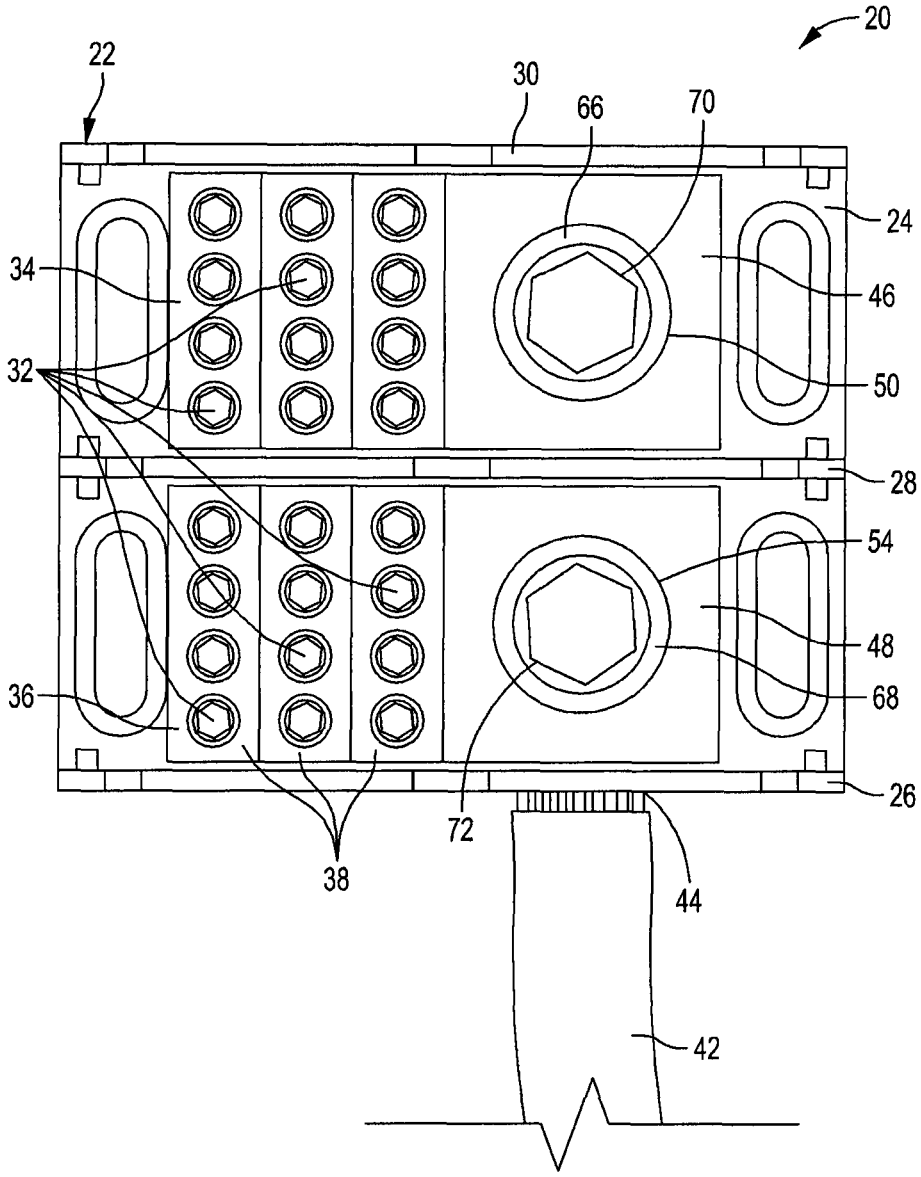
FIG. 3 is a top perspective view of a preferred embodiment of a collector block assembly having input conductors and a single electrical conductor output with connectors located within the collector block assembly.
Figure 4:
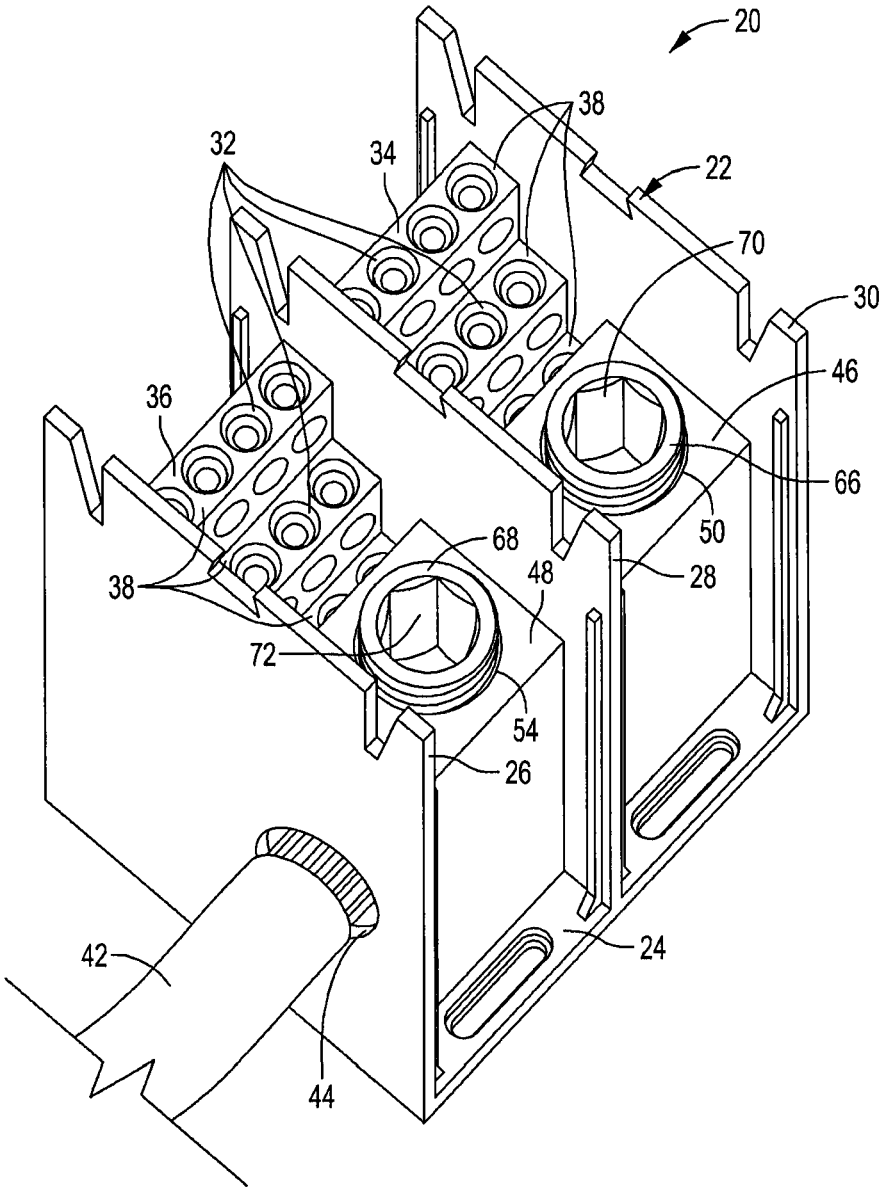
FIG. 4 is a perspective view of a preferred embodiment of a collector block assembly having input conductors and a single electrical conductor output with connectors located within the collector block assembly, as shown in FIG. 3.

The preferred embodiment of a connector block assembly is generally indicated by numeral 20 in FIGS. 3 and 4. There is an insulator base 22 that has a bottom portion 24 with a vertical insulator barrier 26, a vertical insulator barrier middle member 28 and a vertical insulating barrier back member 30 that are all substantially perpendicular to the bottom portion 24. However, the structure of the insulator base 22 can vary tremendously depending on the number of input terminals, which are generally indicated by numeral 32, and the number of poles. In FIGS. 3 and 4, there is an illustrative first pole 34 and a second pole 36. The preferred number of poles for the present invention range from one to five poles, however, any number of poles may be utilized. Typically, additional vertical insulator middle members 28 positioned between poles could be utilized to separate the poles.

Figure 5:
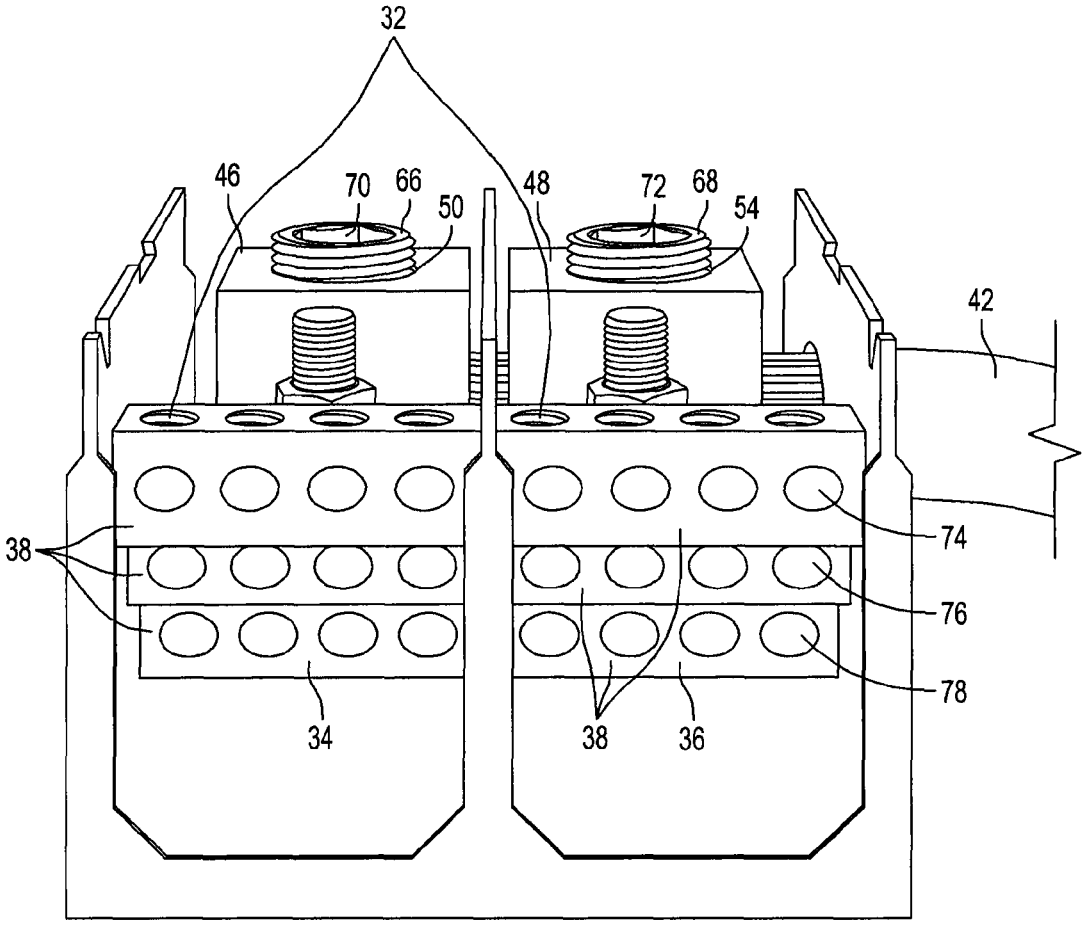
FIG. 5 is a side elevational view of a preferred embodiment of a collector block assembly having input conductors and a single electrical conductor output with connectors located within the collector block assembly, as shown in FIGS. 3 and 4.
Figure 7:
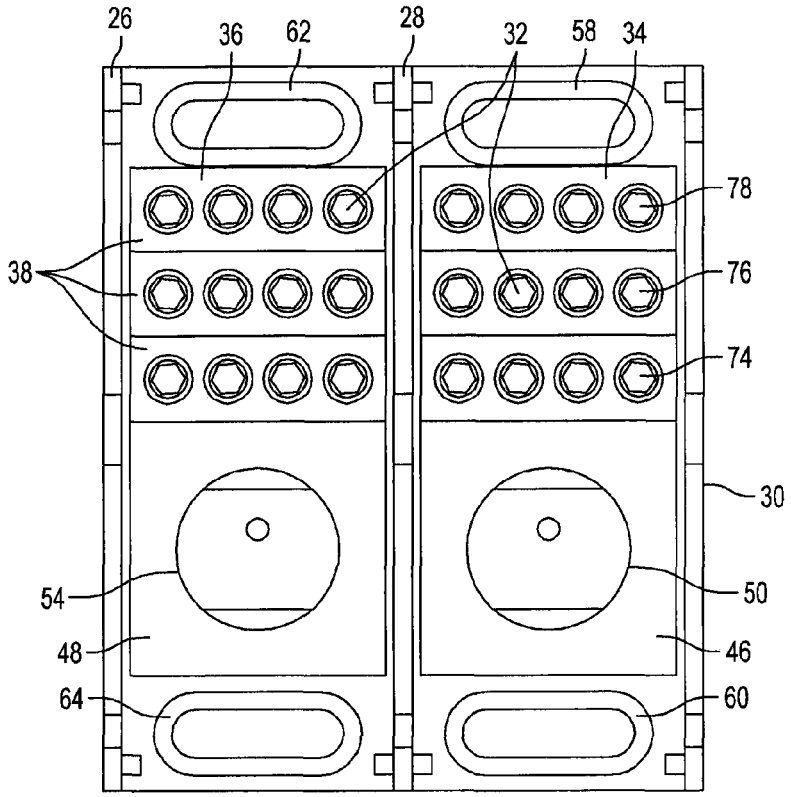
FIG. 7 is a top view of a preferred embodiment of a collector block assembly having input conductors and a single electrical conductor output with securing apertures on the bottom portion of the collector block assembly.

There are a series of input base members 38 that provide numerous input terminals 32. Preferably, but not necessarily, each input base member 38 is formed of conductive material. The series of input base members 38 preferably, but not necessarily, form a tiered structure with several layers, e.g., three (3), with numerous input terminals 32 and other threaded holes as shown in FIGS. 5 and 7. There is a first tier input terminal layer 74, a second tier input terminal layer 76 and a third tier input terminal layer 78.

Although each input terminal 32 can vary tremendously, the preferred example utilizes threaded holes for securing an input conductor with threaded set screw (not shown). Illustrative, but nonlimiting, examples of input conductors (otherwise known as stings) typically, but not necessarily, include #2 to #14 AWG wire gauge inputs. The illustrative, but nonlimiting, number of input terminals 32 includes twelve (12), twenty-four (24), thirty-six (36), forty-eight (48) and sixty (60) with the illustrative, but nonlimiting, example shown in FIGS. 3 and 4 depicting twenty-four (24) input terminals 32.

There is a single electrical conductor output 42 that can be a large diameter insulated conductor, solid or multiple strands, as well as an insulated metal, as shown in FIGS. 3, 4 and 5. A wide variety of conductive material will suffice with the preferred materials being copper or aluminum. An illustrative, but nonlimiting example, of conductor range is between 600 kcmil to #4 AWG conductor gauge.

The single electrical conductor output 42 is electrically connected to each of the input terminals 32 transversely at about seventy degrees to about one hundred-ten degrees in relationship to the plurality of input terminals 32. Preferably, this is at an angle of about eighty degrees to about one hundred degrees in relationship to the plurality of input terminals 32 and more preferably at an angle of about eighty-five degrees to about ninety-five degrees in relationship to the plurality of input terminals 32. The optimal embodiment is being substantially perpendicular at an angle of about ninety degrees in relationship to the plurality of input terminals 32, which is illustrated in FIGS. 3, 4, and 5.

Figure 6:
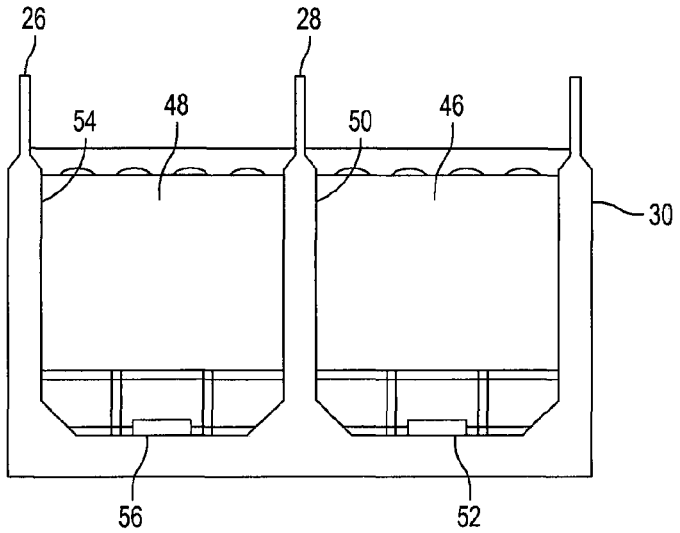
FIG. 6 is a cut-way elevational view of the connectors for the single electrical conductor output as shown in FIGS. 3 through 5.

There is an aperture 44 in the vertical insulating barrier 26 of the insulator base 22 that allows the single electrical conductor output 42 to exit the connector block assembly 20 as shown in FIGS. 3, 4, and 5. There is a first connector 46 and a second connector 48, preferably, but not necessarily, one for each pole. The first connector 46 and the second connector 48 clamp and secure the single electrical conductor output 42 and are preferably, but not necessarily, rectangular structures as also shown in FIGS. 3, 4, 5 and 7 but literally any geometric shape may suffice if the single electrical conductor output 42 can be physically secured. As best shown in FIG. 6, the first connector 46 is positioned between the vertical insulating back barrier 30 and the vertical insulating middle member 28 and includes a first threaded top opening 50 and a first curved support bottom surface 52. The second connector 48 is positioned between the vertical insulating barrier 26 and the vertical insulating middle member 28 and includes a second threaded top opening 54 and a second curved support bottom surface 56.

A first threaded bolt 66, having a first hex head threaded opening 70 for clamping, is threadedly received within the first threaded opening 50 in the first pole 34 to secure the single electrical conductor output 42 as shown in FIGS. 3, 4 and 5. A second threaded bolt 68, having a second hex head threaded opening 72 for clamping, is threadedly received within the second threaded opening 54 in the second pole 36 to secure the single electrical conductor output 42 as shown in FIGS. 3, 4 and 5. However, any of a variety of hardware connectors or attachment mechanisms will suffice. The input base members 38 and the first and second connectors 46 and 48, respectively, are secured within the insulator base 22 by a wide variety of hardware attachment mechanisms or adhesives (not shown).

As shown in FIG. 7, there is a first aperture 58 and a second aperture 62 that allows hardware to secure the first pole 34 to an electrical panel (not shown) and a third aperture 60 and a fourth aperture 64 to secure the second pole 36 to an electrical panel (not shown).

Figure 8:
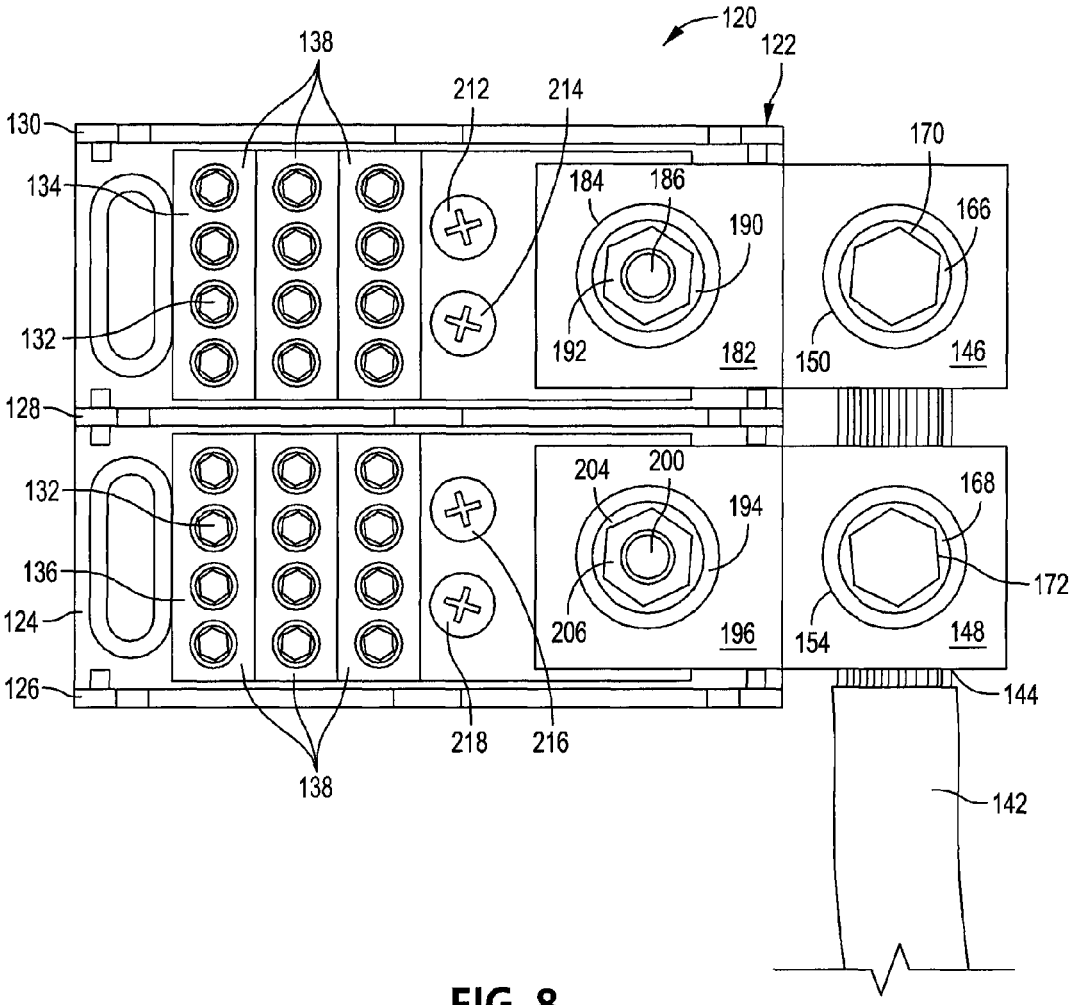
FIG. 8 is a top perspective view of an alternative embodiment of a collector block assembly having input conductors and a single electrical conductor output with connectors located outside the collector block assembly.
Figure 9:
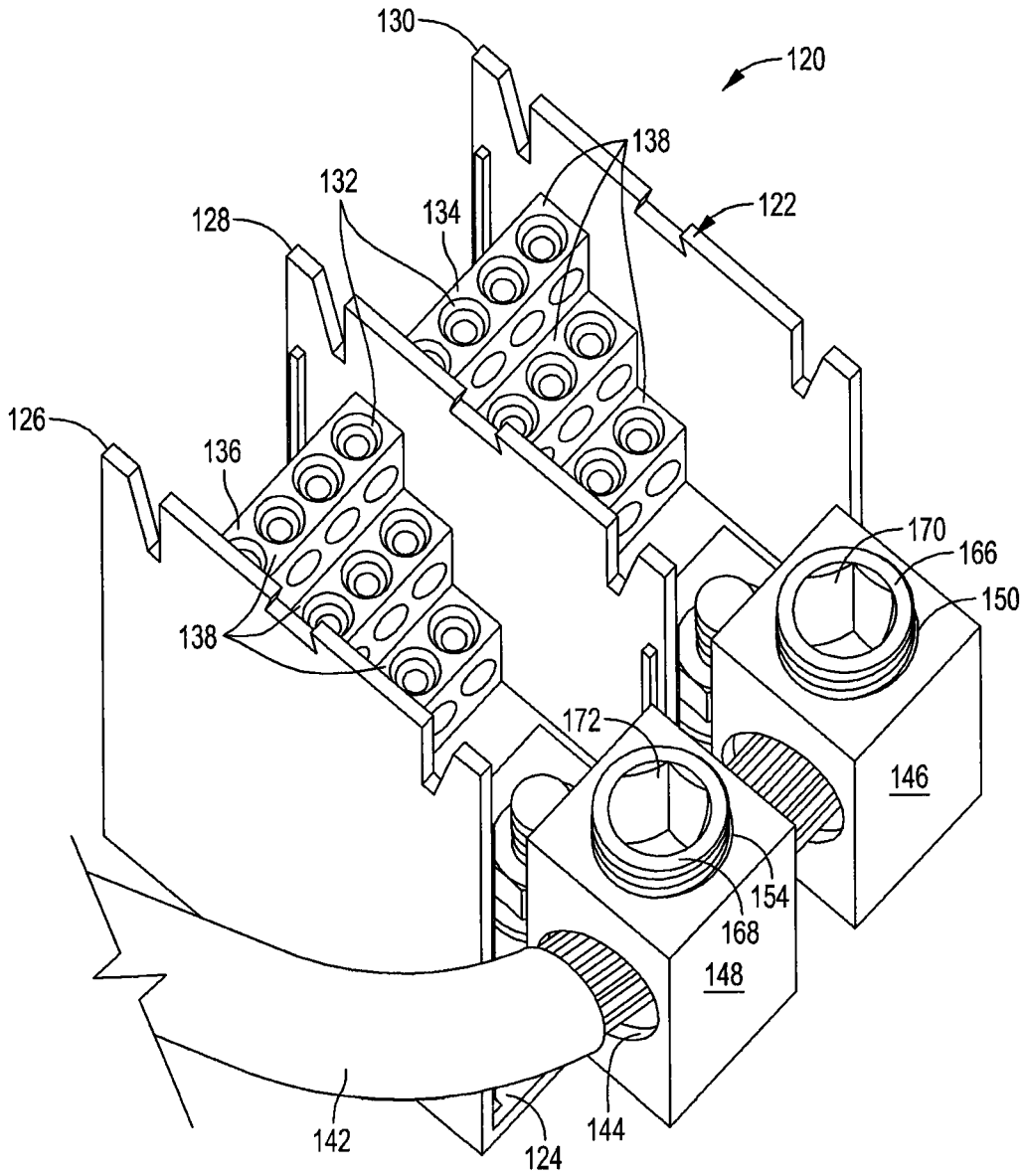
FIG. 9 is a perspective view of an alternative embodiment of a collector block assembly having input conductors and a single electrical conductor output with connectors located outside the collector block assembly, as shown in FIG. 8.
Figure 10:
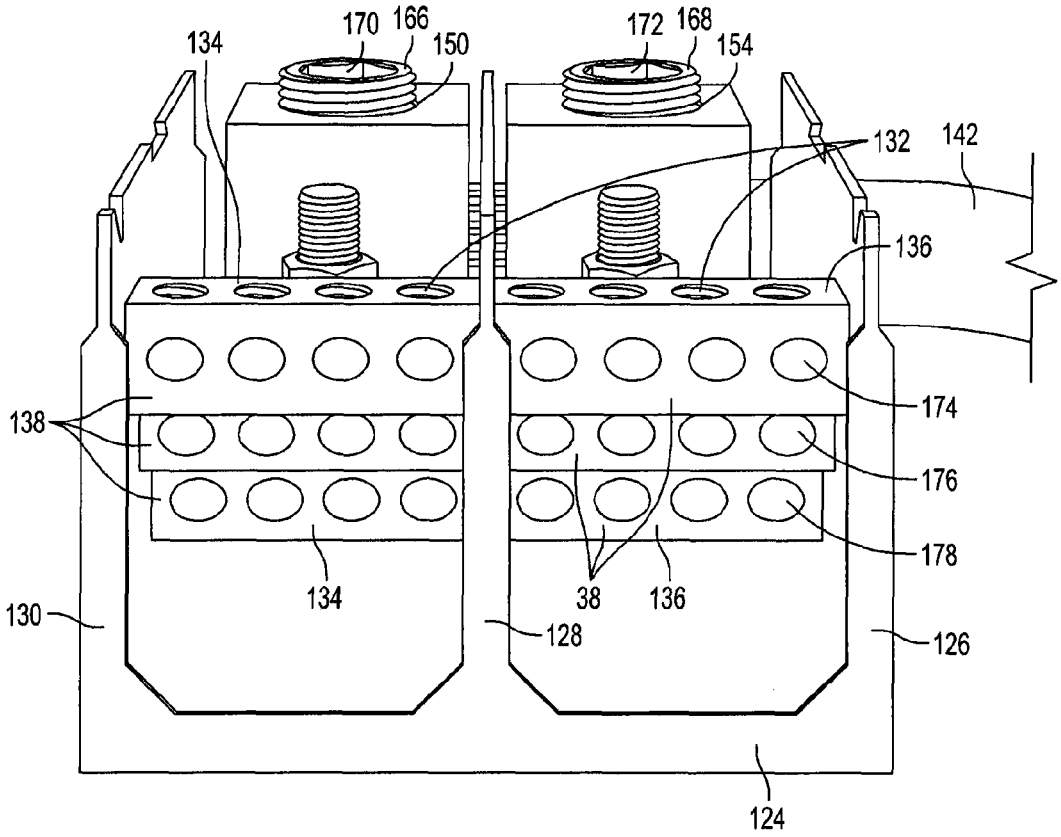
FIG. 10 is a side elevational view of an alternative embodiment of a collector block assembly having input conductors and a single electrical conductor output with connectors located outside the collector block assembly, as shown in FIGS. 8 and 9.

An alternative embodiment of a connector block assembly is generally indicated by numeral 120 in FIGS. 8, 9 and 10. There is an insulator base 122 that has a bottom portion 124 with an upwardly extending front barrier 126, an upwardly extending middle barrier 128 and an upwardly extending back barrier 130 that are all substantially perpendicular to the bottom portion 124. However, the structure of the insulator base 122 can vary tremendously depending on the number of input terminals, which are generally indicated by numeral 132 and the number of poles. In FIGS. 8, 9 and 10, there is an illustrative first pole 134 and a second pole 136. The preferred number of poles for the present invention range from one to five poles, however, any number of poles may be utilized. Typically, additional upwardly extending middle barriers 128 positioned between poles could be utilized to separate the poles.

Figure 12:
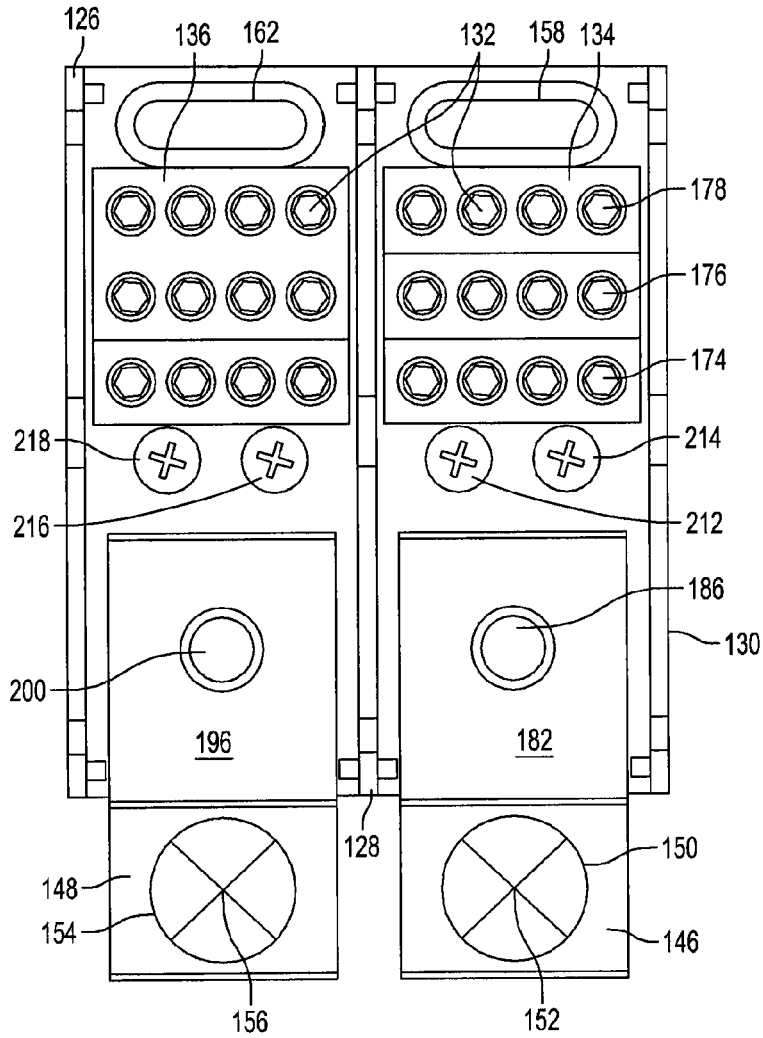
FIG. 12 is a top view of an alternative embodiment of a collector block assembly having input conductors and a single electrical conductor output with securing apertures on the bottom portion of the collector block assembly with connectors located outside the collector block assembly, as shown in FIGS. 8, 9, 10 and 11.
Figure 13:
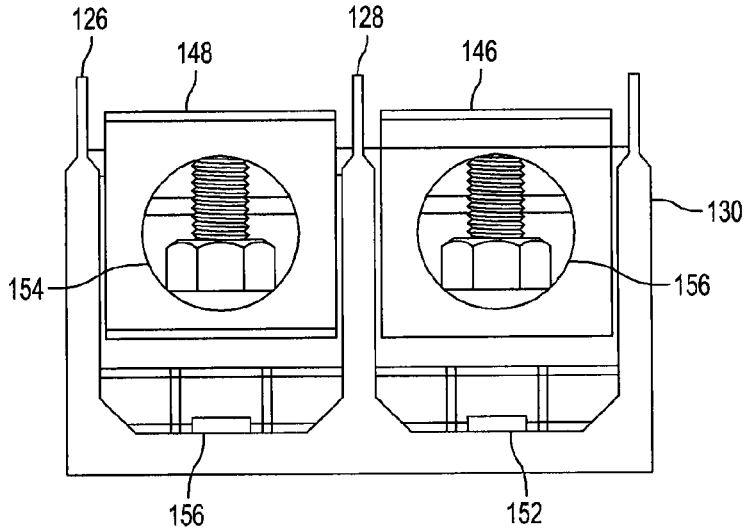
FIG. 13 is a cut-way elevational view of the connectors for the single electrical conductor output as shown in FIGS. 8, 9, 10, 11 and 12 for the alternative embodiment of a collector block assembly.

There are a series of input base members 138 that provide numerous input terminals 132. Preferably, but not necessarily, each input base member 138 is formed of conductive material. The series of input base members 138 preferably, but not necessarily, form a tiered structure with several layers, e.g., three (3), with numerous input terminals 132 and other apertures as shown in FIGS. 10 and 12. There is a first tier input terminal layer 174, a second tier input terminal layer 176 and a third tier input terminal layer 178.

Although each input terminal 132 can vary tremendously, the preferred example utilizes threaded apertures for securing a threaded connector attached to an input conductor (not shown). Illustrative, but nonlimiting, examples of input conductors (otherwise known as stings) typically, but not necessarily, include #2 AWG to #14 AWG average wire gauge inputs. The illustrative, but nonlimiting, number of input terminals 132 includes twelve (12); twenty-four (24), thirty-six (36), forty-eight (48) and sixty (60) with the illustrative, but nonlimiting, example shown in FIG. 9 includes twenty-four (24) input terminals 132.

The single electrical conductor output 142 is electrically connected to each of the input terminals 132 transversely at about seventy degrees to about one hundred-ten degrees in relationship to the plurality of input terminals 132. Preferably, this is at an angle of about eighty degrees to about one hundred degrees in relationship to the plurality of input terminals 132 and more preferably at an angle of about eighty-five degrees to about ninety-five degrees in relationship to the plurality of input terminals 132. The optimal embodiment is being substantially perpendicular at an angle of about ninety degrees in relationship to the plurality of input terminals 132, which is illustrated in FIGS. 8, 9 and 10.

There is a first connector 146 and a second connector 148, preferably, but not necessarily, one for each pole, which are attached to the outside of the insulator base 122, as shown in FIGS. 8, 9, and 10. The first connector 146 and the second connector 148 hold and secure the single electrical conductor output 142 and are preferably, but not necessarily, rectangular structures, but literally any geometric shape may suffice if the single electrical conductor output 142 can be physically secured. There is an aperture 144 in the second connector 148 that allows the single electrical conductor output 142 to exit the connector block assembly 120.

As best shown in FIGS. 8, 9, 10 and 13, the first connector 146 is positioned between the upwardly extending back barrier 130 and the upwardly extending middle barrier 128 and attached to the outside of the insulator base 122 and includes a first threaded top opening 150 and a first curved support bottom surface 152. The second connector 148 is positioned between the upwardly extending front barrier 126 and the upwardly extending middle barrier 128 and includes a second threaded top opening 154 and a second curved support bottom surface 156.

Figure 11:
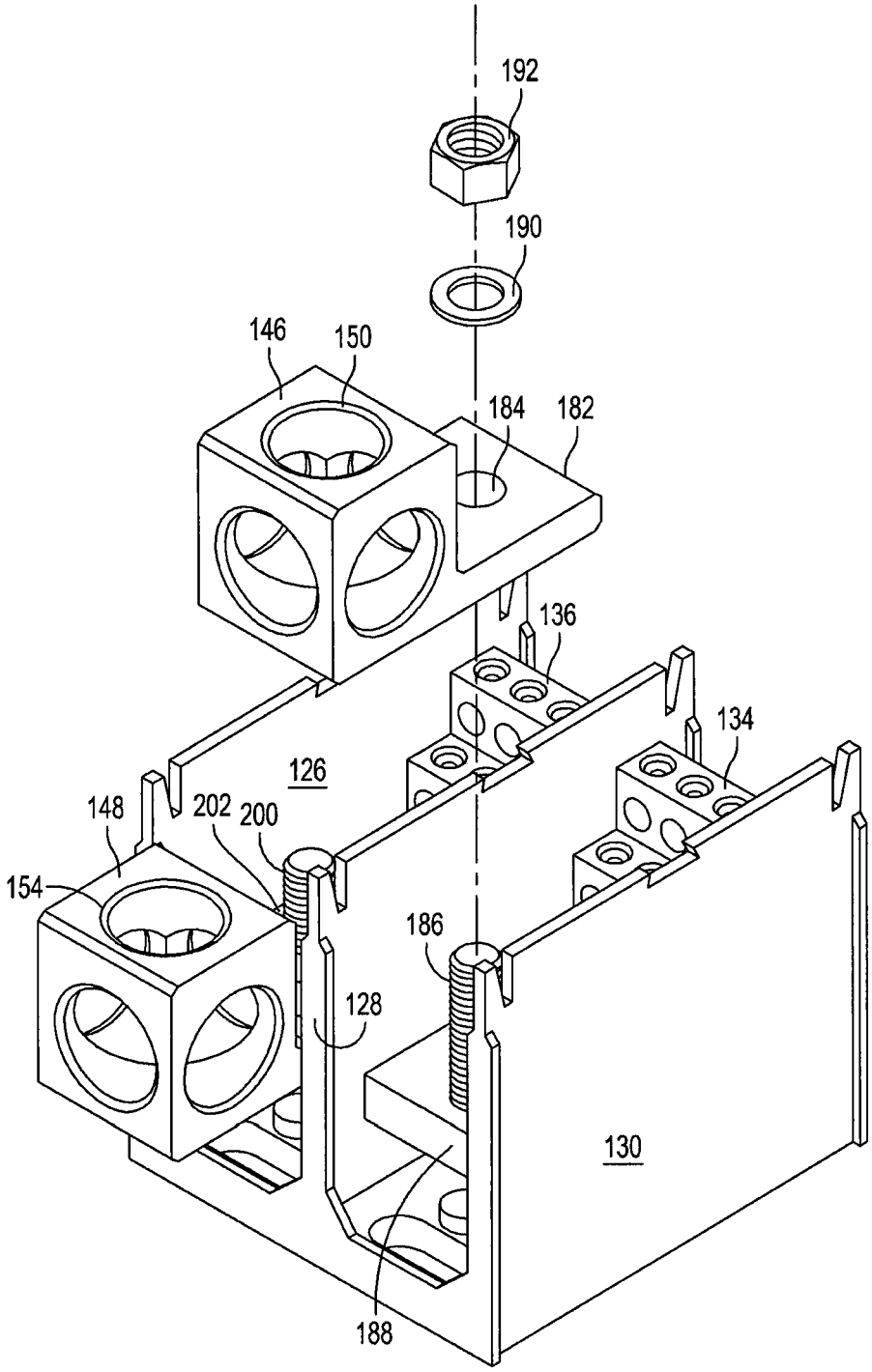
FIG. 11 is a perspective view of an alternative embodiment of a collector block assembly having input conductors and a single electrical conductor output with an exploded view of a connector located outside the collector block assembly, as shown in FIGS. 8, 9 and 10.

The first connector 146 includes a flange member 182 having an aperture 184 that connects a threaded bolt 186 to a base member 188, shown in FIG. 11, which is an integral component thereof or physically attached to the first pole 134 of an input base member 138 as shown in FIGS. 8 and 11. There is also a washer 190 and nut 192 for securing the first connector 146 to the base member 188 with the threaded bolt 186. The second connector 148 includes a flange member 196 having an aperture 198 that connects a threaded bolt 200 to a base member 202, shown in FIG. 11, which is an integral component thereof or physically attached to the second pole 136 of an input base member 138. There is a washer 204 and nut 206 for securing the second connector 148 to the base member 188 with the threaded post 200, as shown in FIGS. 8 and 11. The hardware utilized above is merely illustrative, with a wide variety of known securing mechanisms that will suffice.

There is a first threaded fastener 166, having a first drive feature threaded opening 170 for clamping, that is threadedly received within the first threaded opening 150 in the first pole 134 to secure the single output connector 142, as shown in FIGS. 8, 9, and 10. There is a second threaded fastener 168, having a second drive feature threaded opening 172 for clamping, is threadedly received within the second threaded opening 154 in the second pole 136 to secure the single output connector 142, as shown in FIGS. 8, 9 and 10. However, any of a variety of hardware connectors or attachment mechanisms will suffice. The input base members 138 and the first connector 146 and second connector 148 are secured to the insulator base 122 by a wide variety of hardware attachment mechanisms or adhesives (not shown). There are apertures 158 and 162 shown in FIG. 12 for securing the insulator base 122 to an electrical panel or similar type of electrical enclosure.

As shown in FIG. 8, there is a first screw 212 and a second screw 214 that allows hardware to secure the first pole 134 to the bottom portion 124 of the insulator base 122 and a third screw 216 and a fourth screw 218 to secure the second pole 136 to the bottom portion 124 of the insulator base 122. However, any of a wide variety of attachment hardware and adhesives will suffice.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there have been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

The invention claimed is:

1. A connector block assembly comprising:

a plurality of input terminals for receiving electrical input voltage;

a single electrical conductor output that is electrically connected to the plurality of input terminals; and an insulator base; wherein the plurality of input terminals for receiving electrical input voltage and the single electrical conductor output are transversely mounted with the plurality of input terminals for receiving electrical input voltage located within the insulator base and the single electrical conductor output attached to the outside of the insulator base so that the single electrical conductor output is at an angle of about seventy degrees to about one hundred-ten degrees in relationship to the plurality of input terminals.

2. The connector block assembly in accordance with claim 1, wherein the plurality of input terminals for receiving electrical input voltage and the single electrical conductor output are transversely mounted so that the single electrical conductor output is at an angle of about eighty degrees to about one hundred degrees in relationship to the plurality of input terminals.

3. The connector block assembly in accordance with claim 1, wherein the plurality of input terminals for receiving electrical input voltage and the single electrical conductor output are transversely mounted so that the single electrical conductor output is at an angle of about eighty-five degrees to about ninety-five degrees in relationship to the plurality of input terminals.

4. The connector block assembly in accordance with claim 1, wherein the plurality of input terminals for receiving electrical input voltage and the single electrical conductor output are transversely mounted so that the single electrical conductor output is substantially perpendicular at an angle of about ninety degrees in relationship to the plurality of input terminals.

5. The connector block assembly in accordance with claim 1, wherein the plurality of input terminals for receiving electrical input voltage include a plurality of threaded apertures mounted in a plurality of poles.

6. The connector block assembly in accordance with claim 1 wherein the plurality of input terminals for receiving electrical input voltage include a plurality of threaded apertures mounted in a plurality of poles, wherein the plurality of input terminals are mounted on a plurality of input bases that are tiered and attached to the connector block assembly.

7. The connector block assembly in accordance with claim 1, wherein the single electrical conductor output is attached to the insulator base through at least one connector.

8. The connector block assembly in accordance with claim 1, wherein the at least one connector includes a rectangular structure with a threaded opening for receiving a threaded barrier that can hold the single electrical conductor output within an aperture with the at least one connector.

* * * * *